US006952164B2

(12) United States Patent
Junqua

(10) Patent No.: US 6,952,164 B2
(45) Date of Patent: Oct. 4, 2005

(54) DISTRIBUTED APPARATUS TO IMPROVE SAFETY AND COMMUNICATION FOR LAW ENFORCEMENT APPLICATIONS

(75) Inventor: Jean-Claude Junqua, Santa Barbara, CA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 154 days.

(21) Appl. No.: 10/287,954

(22) Filed: Nov. 5, 2002

(65) Prior Publication Data

US 2004/0085203 A1 May 6, 2004

(51) Int. Cl.[7] ..... G08B 21/00

(52) U.S. Cl. ..... 340/539.13; 340/5.82; 340/5.83; 340/5.81; 340/539.12; 340/539.17; 340/573.1; 380/23; 380/25; 235/380; 235/382

(58) Field of Search ..... 340/5.82, 5.83, 340/5.81, 539.12, 539.13, 539.17, 573.1; 380/23, 25; 235/380, 382

(56) References Cited

U.S. PATENT DOCUMENTS 4,993,068 A * 2/1991 Piosenka et al. ..... 713/186
5,473,144 A * 12/1995 Mathurin, Jr. ..... 235/380
5,689,809 A 11/1997 Grube et al.
5,864,623 A * 1/1999 Messina et al. ..... 340/5.86
6,021,371 A 2/2000 Fultz
6,141,436 A 10/2000 Srey et al.
6,185,503 B1 2/2001 Sumizawa
6,198,394 B1 * 3/2001 Jacobsen et al. ..... 340/573.1
6,317,684 B1 11/2001 Roeseler et al.
2002/0036565 A1 * 3/2002 Monroe ..... 340/425.5

OTHER PUBLICATIONS

U.S. Appl. No. 09/929,634, entitled "Apparatus for Efficient Dispatch and Selection of Information in Law Enforcement Applications", by Rigazio, et al., filed Aug. 18, 2001.

* cited by examiner

*Primary Examiner*—Tai T. Nguyen
(74) *Attorney, Agent, or Firm*—Harness, Dickey & Pierce, PLC

(57) ABSTRACT

A wearable, computerized apparatus for use with law enforcement has an evidence collector adapted to collect evidentiary information of a type collected according to law enforcement procedures and useful for identification of a suspect. It further has a safety monitor adapted to collect safety information relating to well-being of an officer. A wireless communications link communicates the evidentiary information and the safety information to a centralized component of a distributed communications system to assist in identifying suspects and dispatching assistance.

23 Claims, 5 Drawing Sheets

DISTRIBUTED APPARATUS TO IMPROVE SAFETY AND COMMUNICATION FOR LAW ENFORCEMENT APPLICATIONS

FIELD OF THE INVENTION

The present invention generally relates to distributed computer systems for law enforcement applications, and particularly relates to distributed communications systems for law enforcement implementing a wearable, computerized component.

BACKGROUND OF THE INVENTION

Today, laptops are becoming very common in police cars. There exist, however, many safety issues related to operation of these laptops because police officers have to take their eyes off the road or away from an arrested suspect to operate the laptop computer. Furthermore, the computer still has limited communication capabilities, with a central server that is generally only able to respond to requests typed by an officer using a keyboard. Thus, officers are generally limited to typing in driver's license and license plate numbers in the field. These limitations make it difficult for an officer to attempt to identify a suspect or provide information to a centralized, dispatch facility at times when it is most needed.

What is needed is a device that an officer can take into the field and use to safely collect information on-site, communicate the information off-site to a centralized, dispatch facility, and communicate information from the off-site facility to the officer. The present invention provides such a device in concert with a distributed communications system.

SUMMARY OF THE INVENTION

According to the present invention, a wearable, computerized apparatus for use with law enforcement has an evidence collector adapted to collect evidentiary information of a type collected according to law enforcement procedures and useful for identification of a suspect. It further has a safety monitor adapted to collect safety information relating to well-being of an officer. A wireless communications link communicates the evidentiary information and the safety information to a centralized component of a distributed communications system to assist in identifying suspects and dispatching assistance.

The distributed communication system according to the present invention is advantageous over previous distributed computer systems for law enforcement applications in that the wearable, computerized component assists an officer in collecting and communicating important information quickly and conveniently, and with increased safety. A vehicular component having an on-site camera can receive data from the wearable, computerized component via a wireless connection, automatically activate the camera at times of stress and/or distress, and forward collected information off-site to a centralized, dispatch facility via a wireless connection. The centralized, dispatch facility can, in turn, dispatch any needed assistance based on the type of situation and the camera images. It can further process biometric data of suspects to assist in identifying suspects, and determine if any warrants are issued with respect to an identified suspect. The camera images, suspect identification, and information relating to the suspect can be forwarded to vehicles of other officers and to the vehicle of the officer in question. Received communications may be wirelessly communicated to the wearable, computerized component and, thus, to the officer. The wearable computerized component preferably makes use of speech recognition and speech generation technologies to allow hands-free operation of the device wherever possible. Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

The present invention is described below with reference to a distributed architecture employing a wearable, computerized component, an on-site, vehicular component, and an off-site, centralized component. The following description of the preferred embodiment, however, is merely exemplary in nature and is in no way intended to limit the invention, its application, or uses.

Figure 1:
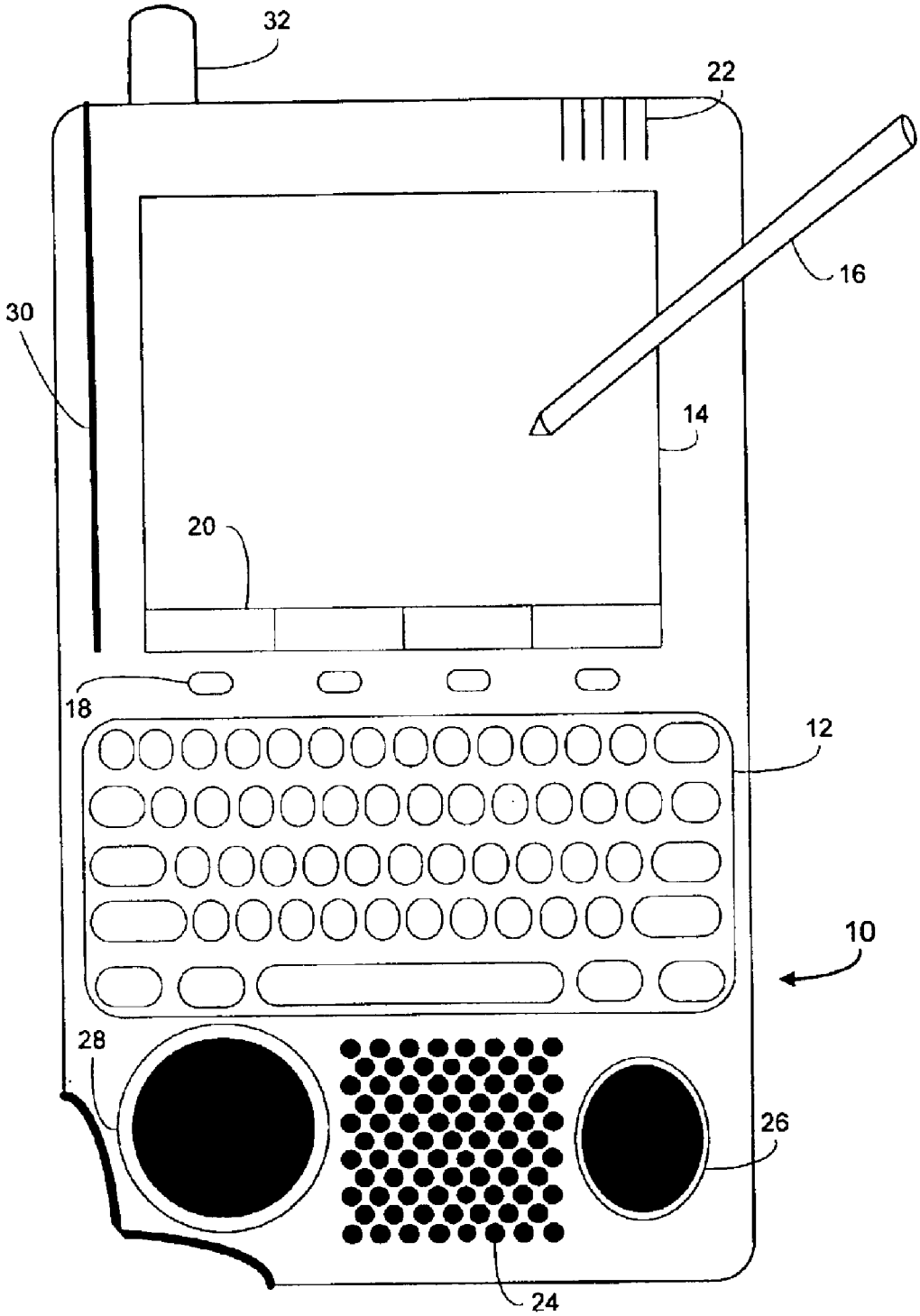
FIG. 1 is a block diagram providing a perspective view of a wearable, computerized component of a distributed computer system for law enforcement applications according to the present invention.

The wearable, computerized apparatus 10 according to the present invention is illustrated in FIG. 1. It is generally modeled on a personal digital assistant (PDA) having a small keyboard 12, touch screen 14, and stylus 16. A plurality of hot keys 18 provide easy access to preprogrammed functions 20, such as license plate number voice input, driver's license number scanning, retinal scanning, fingerprint sensing, on-site camera activation, and/or calling for assistance. These functions 20 are also preferably selectable by voice using speech recognition technology. Thus, apparatus 10 has a microphone input 22, and also a speaker output 24 to permit communication of sound, including generated speech. Additionally, a fingerprint sensor 26 and retinal scanner 28 are provided for collecting biometric data from a suspect, as well as a smart card reader 30 for reading a magnetic strip on a driver's license. Also, a two-way, wireless link 32 is capable of transmitting and receiving data in at least one of many possible ways.

Figure 2:
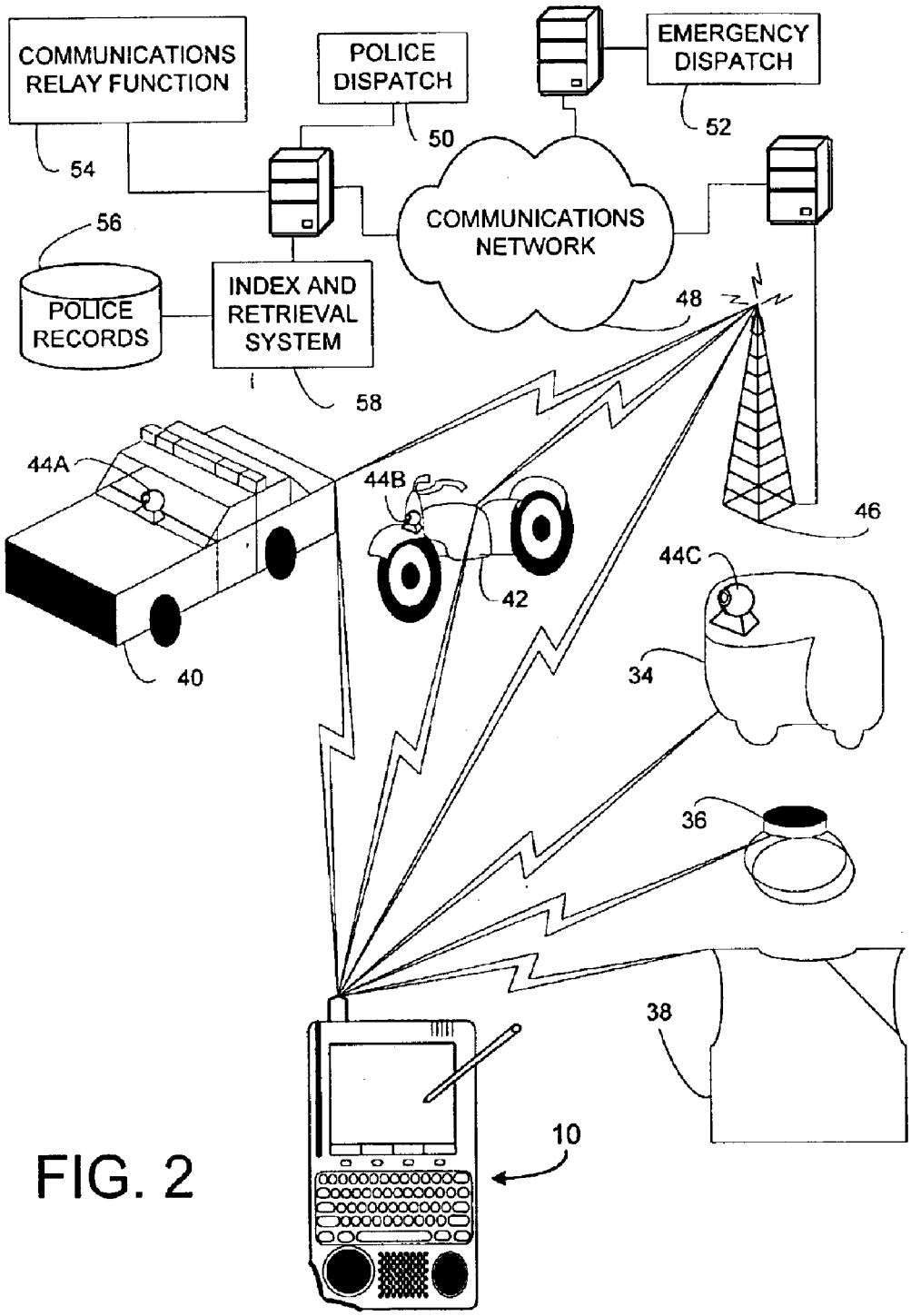
FIG. 2 is a partial perspective view and block diagram depicting various components of the distributed computer system according to the present invention.

The distributed communications system of FIG. 2 demonstrates many of the ways apparatus 10 can communicate with other components of the system. For example, apparatus 10 can use a short range wireless link, such as Bluetooth, to communicate with sensors disposed in various accoutrements of the officer, such as a helmet 34, wristwatch 36, and bullet-proof vest 38. These sensors, in turn, can sense and communicate data relating to stimuli affecting the officer and officer reactions to stimuli. Thus, a sensed impact to the bullet proof vest and/or external temperature, can be communicated as stimuli to the apparatus. Similarly, sensed heart rate, respiratory rate, body temperature, blood pressure, perspiration, and/or blood loss can be communicated as officer reactions to apparatus 10.

Another way that apparatus 10 can communicate with other components of the system is by using a mid-range wireless link, such as radio wave. This mid-range wireless link can be used to communicate with a vehicular component of the system, such as a police car 40 or motorcycle 42. Thus, suspect biometric data, sensed officer reactions, stimuli, scanned input, text input, voice input and/or sounds and images from various on-site cameras 44A-C can be communicated to and from various on-site components of the distributed communications system.

Still another way that apparatus 10 can communicate with other components of the system is by using a long-range communication link, such as shortwave radio and/or cell phone technology, to communicate off-site via a communications tower 46 and adjacent network 48. Additionally, a vehicular component of the system can use a long range wireless link to forward any communications between an off-site, centralized component of the system and apparatus 10. It should be readily apparent that several combinatorial options are available according to this same communications architecture, including long-range communication capability being provided by various officer accoutrements.

Figure 3:
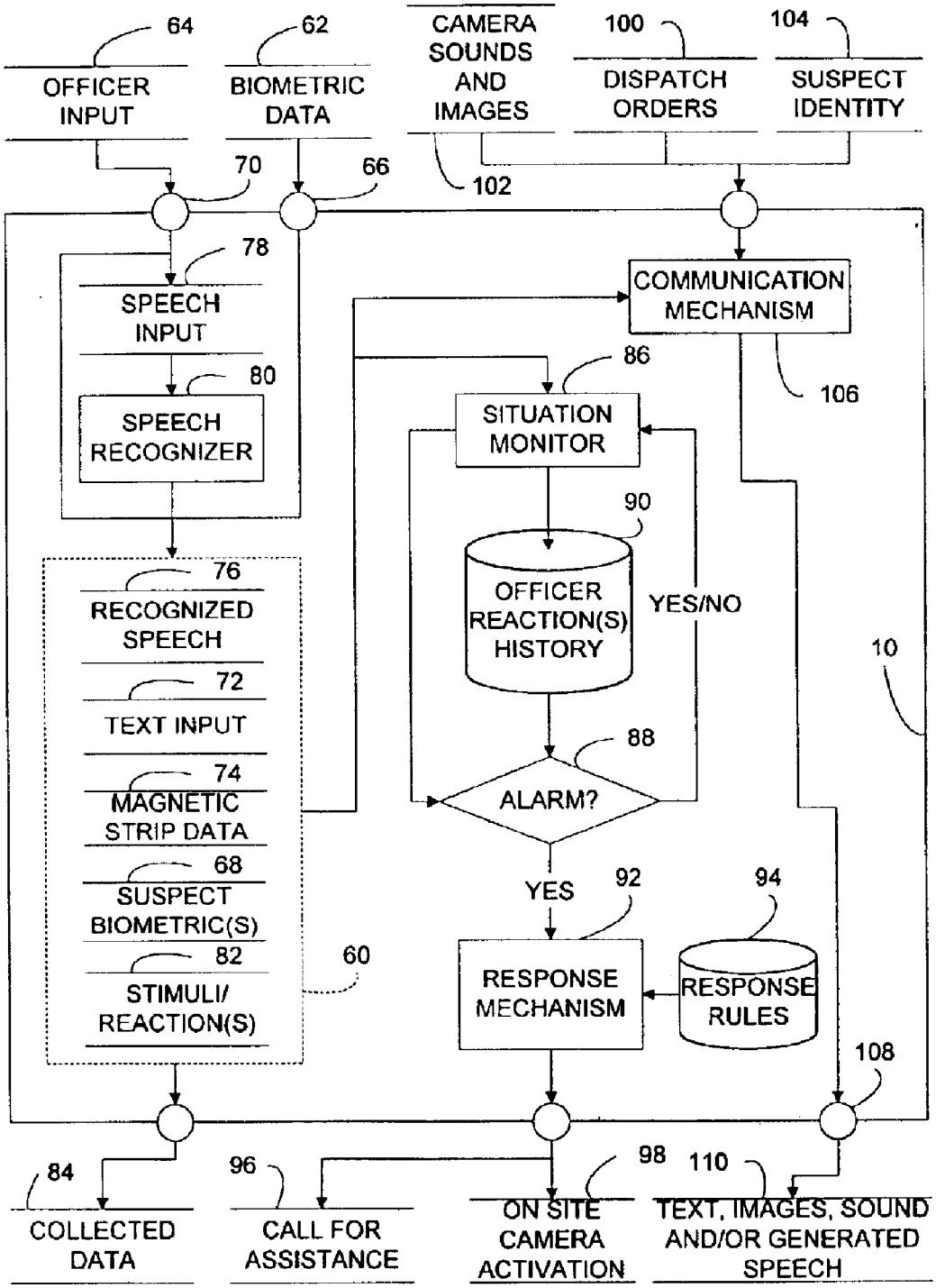
FIG. 3 is a schematic block diagram of a wearable, computerized component of a distributed communication system according to the present invention.

Off-site centralized components of the system can use these same available communications mechanisms to communicate with apparatus 10, for example, a dispatch order from a police dispatch function 50 and/or an emergency dispatch function 52 can be communicated to apparatus 10. Also, suspect biometric data, sensed officer reactions, stimuli, scanned input, text input, voice input and/or sounds and images from various on-site cameras 44A-C can be communicated from one on-site location to another on-site location via communications relay function 54. Further, an identification of a suspect and/or information relating to an identified suspect, such as issued warrants, resulting from use of police record database 56 and index and retrieval system 58 can be communicated to apparatus 10. This distributed communications architecture is important to functionality of apparatus 10 as further explored in FIG. 3, and to other components of the system.

In operation, apparatus 10 is able to collect information 60 based on biometric data 62 and officer input 64. The biometric data 62 is input using one or more biometric sensors 66, such as a retinal scanner and/or fingerprint sensor, and includes suspect biometrics 68. The officer input 64 is received by one or more interface devices 70, such as a keyboard, touch screen with stylus, microphone, smart card reader, and short-range data link with associated sensors. Thus, the officer input 64 may include text input 72, data embodied in a magnetic strip 74, recognized speech 76 from a speech input 78 processed via a speech recognizer 80, and/or sensed stimuli and/or reactions 82. Suspect biometrics 68, text input 72, data embodied in a magnetic strip 74, recognized speech 76, and sensed stimuli and/or reactions 82, thus, are exemplary types of collected information 60 that can be output as collected data 84 for delivery off-site.

Various components of collected information 60 are further useful in connection with operation of apparatus 10. For example, recognized speech 76, text input 72, and sensed stimuli and/or reactions 82 may be communicated to situation monitor 86. In turn, situation monitor 86 may determine cause for alarm as at 88 based on recognized speech 76, a hot key activation component of text input 72, and/or sensed stimuli of sensed stimuli and/or reactions 82. Further, situation monitor 86 may determine cause for alarm as at 88 based on sensed stimuli and/or reactions 82 based on an adaptive threshold mechanism using an officer reactions history 90. Thus, a sudden increase in heart rate, respiration, and/or perspiration may be interpreted as cause for alarm at 88. Similarly, detection of blood, a drop in blood pressure and/or absence of heart rate and/or respiration may be interpreted as cause for alarm at 88. Accordingly, response mechanism 92 issues an alarm based on predetermined response rules 94, thus resulting in output of call for assistance 96 and/or a command for on-site camera activation 98.

Yet further to the operation of apparatus 10, received communications from off-site, such as dispatch orders 100, camera sounds and images 102 from another on-site location, and/or suspect identity 104 with relevant information, are processed by a communication mechanism 106. Communication mechanism 106 displays camera images and suspect identity 104 and relevant information via a touch screen of interface 108, while generating speech to communicate important portions of relevant information. Camera sounds, dispatch orders, and generated speech are communicated to the officer via a speaker output of interface 108. Recognized speech 76 and/or text input 72 are also communicated to communication mechanism 106 as needed to permit the officer to carry on a dialogue with apparatus 10. Thus, the officer can prompt the device for specific types of information, and/or express preferences relating to how the communications are presented. As a result, text, images sound, and/or generated speech 110 are communicated to the officer in a facilitated fashion.

Figure 4:
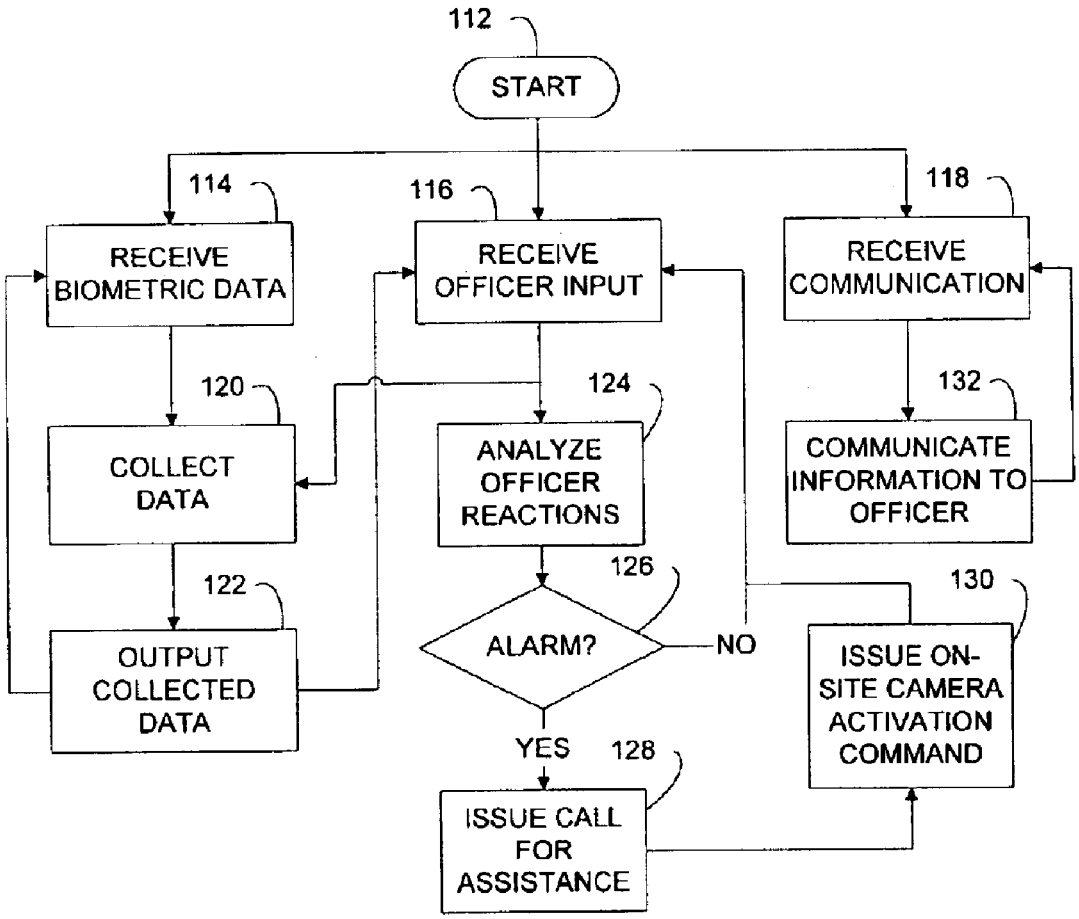
FIG. 4 is a flow chart depicting a method of operation for a wearable, computerized component of a distributed communication system according to the present invention.

A method of operation for a wearable, computerized component of a distributed communications system according to the present invention is illustrated in FIG. 4. Beginning at 112, biometric data, officer input, and communications from off-site are received respectively at steps 114, 116, and 118. Received suspect biometrics and officer input are collected as data at step 120, and the collected data is output at step 122 in accordance with transmission and routing protocols selected by voice input and/or hot key activation, and in accordance with selectable preprogrammed functions. Officer reactions, such as sensed vital signs, are analyzed at step 124, and if the reactions warrant an alarm or if officer input indicates an alarm state as at 126, then a call for assistance is issued at step 128 concurrent with an on-site camera activation command at step 130. Received communications are communicated to the officer at step 132.

Figure 5:
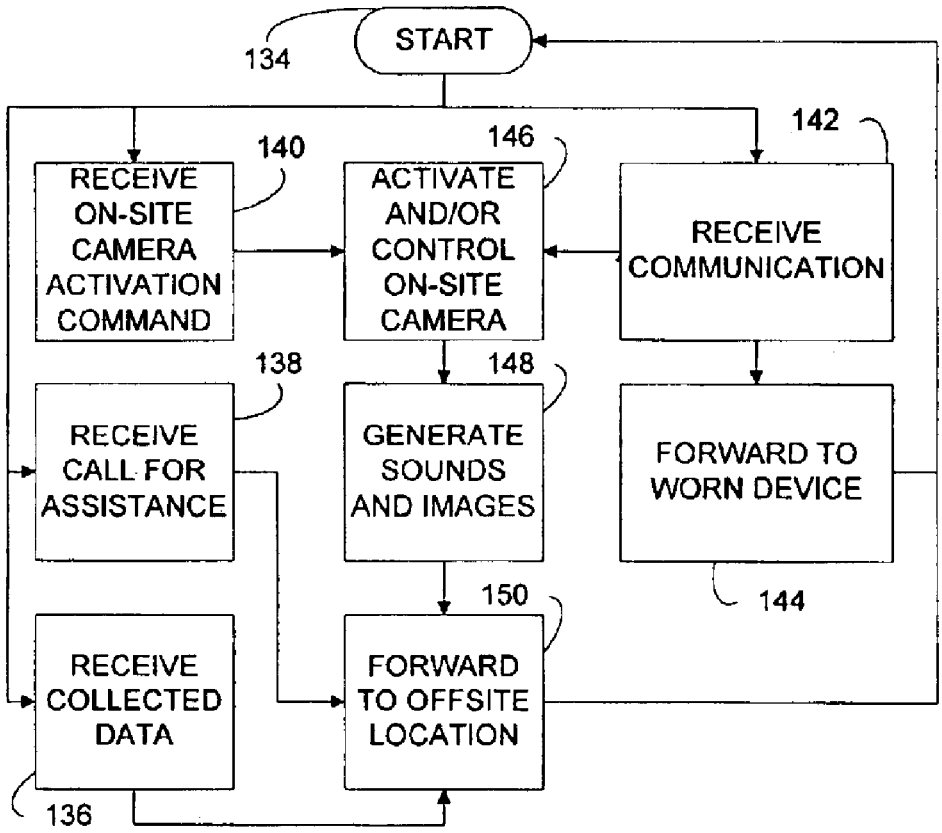
FIG. 5 is a flow chart depicting a method of operation for an on-site, vehicular component of a distributed communication system according to the present invention.
Figure 6:
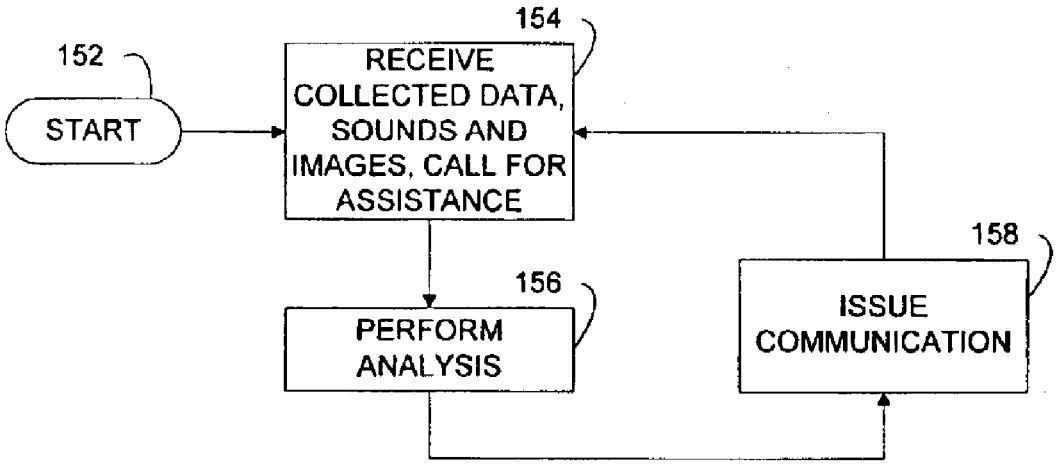
FIG. 6 is a flow chart depicting a method of operation for an off-site, centralized component of a distributed communication system according to the present invention.

The method of operation for the wearable, computerized component of the present invention is designed to operate in concert with methods of operation for an on-site, vehicular component and an off-site centralized component. These methods are illustrated respectively in FIGS. 5 and 6. Beginning at 134, the method of operation for an on-site, vehicular component according to the present invention accommodates reception of collected data, a call for assistance, and/or an on-site camera activation command from the wearable, computerized component at steps 136, 138, and 140, respectively. The method further accommodates reception of communications from an off-site, centralized component at step 142. The communications received at step 142 are typically forwarded to the worn device at step 144. One example exception involves camera control signals affecting control of an on-site camera, which are communicated to the on-site camera. Concurrently, the on-site camera activation and/or control command received at step 140 prompts activation and/or control of an on-site camera at step 146, such that sounds and images generated at step 148 are forwarded to the off-site, centralized component at step 150. In one embodiment, the camera may sense a position of the signal source from the device, and automatically track the position in absence of specific control signals from the centralized component of the system and/or the wearable, computerized component of the system. Further, the collected data and/or call for assistance respectively received in steps 136 and 138 are concurrently forwarded to the off-site, centralized component at step 150.

The method of operation for an off-site, centralized component according to the present invention begins at 152, and accommodates reception of collected data, sounds and images, and/or a call for assistance at step 154. An analysis of the information received in step 154 takes place in step 156, and any appropriate action may concurrently be taken based on the analysis. For example, a human dispatcher may receive the call for assistance, collected data corresponding to officer vital signs, and on-site camera sounds and images. The human dispatcher may issue camera control signals in step 158 to gain better images and/or sounds, and select to dispatch appropriate assistance and forward on-site camera sounds and images to assisting officers and/or medical personnel in step 158. Alternatively or in addition, a suspect name, received biometric data, license plate information, and/or a driver's license number can be automatically processed to identify a suspect and obtain relevant information, such as issued warrants, vehicle ownership, insurance information, and/or arrest records. This automatically retrieved information can be forwarded to the on-site officer and/or to assisting personnel at step 158.

It should be readily understood that the communications architecture can be modified from the form presented herein without departing from the spirit and scope of the present invention. For example, a wearable device according to the present invention may be able to communicate directly with a police station, without requiring a vehicle component or a communications network. Also, wearable computerized components at different on-site locations may be able to communicate directly with one another. It should also be readily understood that functions performed by a particular component of the present invention can be shifted from one component to another without departing from the spirit and scope of the present invention. For example, the situation monitor function may be allocated to the on-site vehicle component or the off-site, centralized component. Further, a backup safety monitoring mechanism may be employed that expects to continuously or periodically receive a signal from the wearable, computerized device, and issues an alarm if the signal is not received as expected. Still further, the microphone and speakers for the wearable device do not have to be on the wearable device, but can be placed on the police officer (headset microphone and headphones) and connected to the wearable device. Thus, the systems and methods of the present invention may take various forms other than those of the preferred embodiment without departing from the spirit and scope of the present invention. Moreover, the description of the invention is merely exemplary in nature and, thus, variations that do not depart from the gist of the invention are intended to be within the scope of the invention.

What is claimed is:

1. A wearable, computerized apparatus for use with law enforcement, the apparatus comprising:

an evidence collector adapted to collect evidentiary information of a type collected according to law enforcement procedures and useful for identification of a suspect;

a safety monitor adapted to collect safety information relating to well-being of an officer, wherein said safety monitor has an officer reaction monitor module receptive of sensed officer reactions to situational stimuli, wherein said officer reaction monitor module, is adapted to generate an alarm when the officer reactions deviate from a safe zone that is adaptively computed based on a continuously maintained officer reactions history; and a wireless communications link adapted to output the evidentiary information and the safety information.

2. The apparatus of claim 1, wherein said evidence collector includes an input adapted to read information embodied in a computer readable recording medium of a type typically carried by individuals as a form of identification.

3. The apparatus of claim 2, wherein the input corresponds to a smart card reader adapted to read information contained in a magnetic strip embedded in a driver's license.

4. The apparatus of claim 1, wherein said evidence collector includes a biometric sensor adapted to capture biometric data of a type collected according to law enforcement procedures and used for identification of a suspect.

5. The apparatus of claim 4, wherein the biometric sensor corresponds to a fingerprint sensor.

6. The apparatus of claim 4, wherein the biometric sensor corresponds to a retinal scanner.

7. The apparatus of claim 1, wherein said safety monitor includes an input receptive of information relating to officer reactions to stimuli, including one or more reactions selected from:

(a) heart rate;

(b) respiratory rate;

(c) body temperature;

(d) blood pressure; and (e) perspiration.

8. The apparatus of claim 1, wherein said safety monitor includes an input receptive of sensed stimuli affecting the officer, including one or more stimuli selected from:

(a) a force impacting the user; and (b) environmental conditions.

9. The apparatus of claim 1, comprising a user interface adapted to receive communications from an officer in a form of at least one of textual input and speech input, wherein said wireless communication link is adapted to output communications received from the officer.

10. The apparatus of claim 1, wherein said wireless communications link is adapted to receive communications, the apparatus comprising:

a user interface adapted to deliver the communications to the officer in a manner readily understandable to the officer.

11. The apparatus of claim 1, wherein said wireless communications link is adapted to output currently sensed officer reactions and the alarm to an officer vehicle, thereby causing an imaging device mounted on the officer vehicle to commence operation in the event of an emergency and relay the currently sensed officer reactions and visual information captured by the imaging device to a remote location for evaluation.

12. The apparatus of claim 11, wherein said imaging device is responsive to control from the remote location to change its position.

13. A method of operation for a wearable, computerized component of a distributed communications system for use with law enforcement applications, comprising:

collecting evidentiary information of a type collected according to law enforcement procedures and useful for identification of a suspect;

collecting safety information relating to well-being of an officer, including continuously maintaining a history of sensed officer reactions to situational stimuli, adaptively computing a safe zone based on the history of sensed officer reactions, and generating an alarm when the officer reactions deviate from the safe zone; and wirelessly outputting the evidentiary information and the safety information.

14. The method of claim 13, wherein said collecting includes reading information embodied in a computer readable recording medium of a type typically carried by individuals as a form of identification.

15. The method of claim 14, wherein said collecting evidentiary information includes reading information contained in a magnetic strip embedded in a driver's license, wherein said reading is accomplished via a smart card reader.

16. The method of claim 13, wherein said collecting evidentiary information includes capturing biometric data of a type collected according to law enforcement procedures and used for identification of a suspect.

17. The method of claim 16, wherein said capturing biometric data corresponds to sensing a fingerprint.

18. The method of claim 16, wherein said capturing biometric data corresponds to scanning a retina.

19. The method of claim 13, wherein said collecting safety information includes receiving sensed information relating to officer reactions to stimuli, including one or more reactions selected from:

(a) heart rate;

(b) respiratory rate;

(c) body temperature;

(d) blood pressure; and (e) perspiration.

20. The method of claim 19, comprising generating an alarm when the user reactions deviate from a safe zone.

21. The method of claim 13, wherein said collecting safety information includes receiving sensed information relating to stimuli affecting the officer, and the stimuli include one or more stimuli selected from:

(a) a force impacting the user; and (b) environmental conditions.

22. The method of claim 13, comprising:

receiving communications from the officer including at least one of textual input and voice input; and wirelessly outputting the communications.

23. The method of claim 13, comprising:

wirelessly receiving a communication; and delivering the communication to the officer in a manner readily understandable to the officer.

* * * * *